United States Patent [19]

Conlee

[11] 4,062,639

[45] Dec. 13, 1977

[54] FLUID MOTOR-DRIVEN PUMP USING FLUID PRESSURE TO SET POSITION OF PILOT VALVE

[75] Inventor: George D. Conlee, Cedar Falls, Iowa

[73] Assignee: The Hotsy Corporation, Humboldt, Iowa

[21] Appl. No.: 677,487

[22] Filed: Apr. 15, 1976

Related U.S. Application Data

[63] Continuation of Ser. No. 521,250, Nov. 6, 1974, abandoned.

[51] Int. Cl.[2] ..... F04B 17/00; F04B 35/00; F01L 25/02

[52] U.S. Cl. ..... 417/404; 91/308; 91/313; 91/316

[58] Field of Search ..... 417/397, 403, 404; 91/313, 304, 308, 316, 342

[56] References Cited

U.S. PATENT DOCUMENTS

| | | | |
|---|---|---|---|
| 208,797 | 10/1878 | Craig | 91/313 |
| 1,536,787 | 5/1925 | Grace | 91/313 |
| 1,624,004 | 4/1927 | Miller | 91/313 |
| 1,816,098 | 7/1931 | Thompson | 91/313 |
| 3,700,360 | 10/1972 | Shaddock | 91/275 |

*Primary Examiner*—Carlton R. Croyle
*Assistant Examiner*—Thomas I. Ross
*Attorney, Agent, or Firm*—Zarley, McKee, Thomte & Voorhees

[57] ABSTRACT

A high pressure pump comprising a valve body having a first housing secured at one of its ends to one end of the valve body and having a body member secured to the other end thereof. A second housing is secured to the body member with a piston rod movably extending through the body member and the first and second housings. A first piston secured to the piston rod and movably positioned in the first housing defines first and second chambers. A second piston secured to the piston rod and movably positioned in the second housing defines third and fourth chambers. Check valve means are in communication with the third and fourth chambers and sources of fluid to be pumped. The valve body has a pilot valve therein. The pilot valve means is connected to the piston rod so that the pilot valve means will be moved from a first position to a second position when the piston rod moves from a first position to a second position and vice versa. The valve body also has a main valve therein. A first passageway means fluidly connects the main valve means and the first chamber with a second passageway means fluidly connecting the main valve means and the second chamber. In their first positions, main valve means and the pilot valve means are fluidly connected so that hydraulic fluid under pressure will be supplied to the first chamber to cause the first and second pistons to move from their first positions towards their second positions. The piston rod moves the pilot valve means to its second position when the piston rod reaches its second position so that hydraulic fluid under pressure is supplied to the main valve means to move the main valve means to its second position so that hydraulic fluid under pressure is supplied to the second chamber to cause the first piston means to move towards its first position.

4 Claims, 6 Drawing Figures

FLUID MOTOR-DRIVEN PUMP USING FLUID PRESSURE TO SET POSITION OF PILOT VALVE

This is a continuation of application Ser. No. 521,250, filed Nov. 6, 1974, now abandoned.

BACKGROUND OF THE INVENTION

This invention relates to a high pressure pump and more particularly to a high pressure pump which will provide high pressures with little or no pulsation and which will operate with a minimum number of parts thereby requiring a minimum of maintenance.

Applicant's earlier U.S. Pat. No. 3,622,250 disclosed a high pressure pump wherein pistons are provided at opposite ends of a piston rod wherein the piston rod extends through a spool valve body separating the cylinders for the oppositely disposed pistons. In applicant's earlier device, a pilot valve body was mounted on the spool valve body and was responsive to reciprocation of the pistons.

The instant invention represents an improvement over applicant's earlier device in that a valve body is provided at one end of a cylinder which is positioned in an end-to-end relationship with a second cylinder separated therefrom by a body member. The instant invention provides a means for pumping water or the like from a pair of sources.

Therefore, it is a principal object of the invention to provide an improved high pressure pump.

A further object of the invention is to provide a high pressure pump having a pilot valve mechanism fluidly connected to a main valve mechanism for switching the apparatus between its cycles.

A further object of the invention is to provide a high pressure pump which is easily fabricated.

A still further object of the invention is to provide a high pressure pump which is effecient in operation and which has adjustment means thereon.

A still further object of the invention is to provide a high pressure pump which is durable in use.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 4:
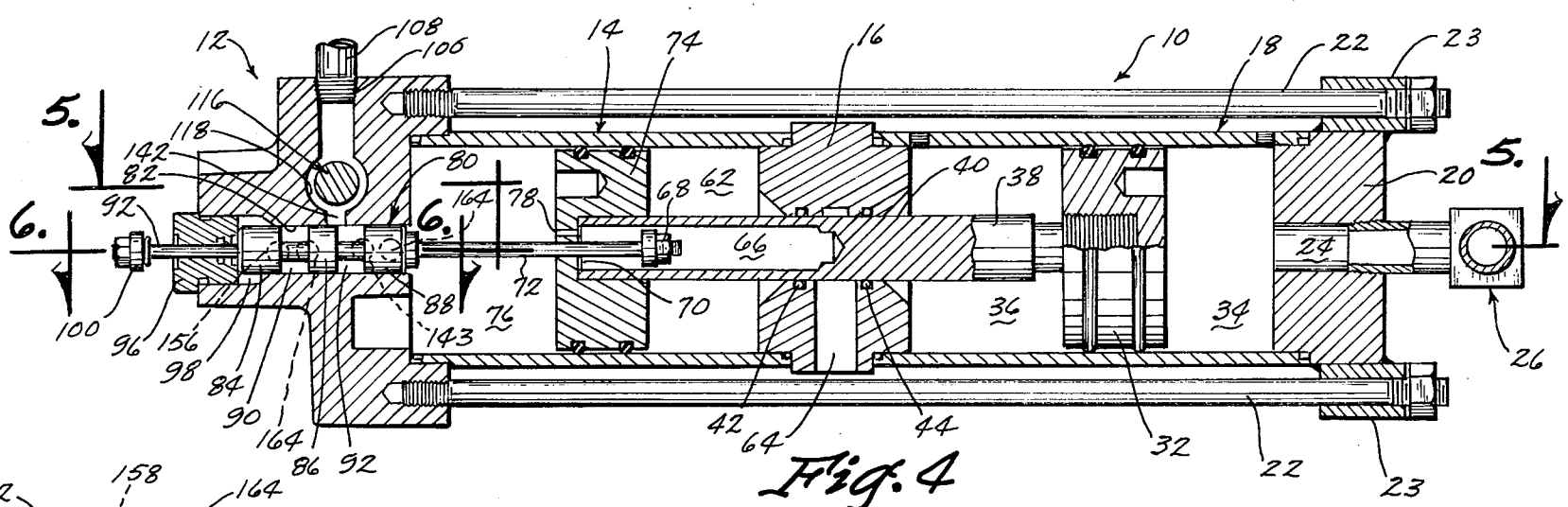
FIG. 4 is a sectional view as seen on lines 4—4 of FIG. 1.

The high pressure pump of this invention is referred to generally by the reference numeral 10 and includes a valve body 12 having a cylinder 14 secured thereto at one side thereof. Body member 16 is mounted at one end of cylinder 14 and has cylinder 18 extending therefrom. Cylinder 18 has a head 20 positioned at one end thereof as seen in FIG. 4. Head 20, cylinder 18, body member 16, cylinder 14 and valve body 12 are held together by the bolts 22 extending through the collars 23 and being threadably received by suitable threaded openings in valve body 12 in the manner illustrated in FIG. 4.

Head 20 has a bore 24 extending therethrough which threadably receives a check valve assembly 26 which is in communication with the water to be pumped. Check valve assembly 26 has check valves 28 and 30 mounted therein which permits the flow of water therethrough as indicated by the arrows in FIG. 5. Piston 32 is slidably mounted in cylinder 18 to define chambers 34 and 36 on opposite sides thereof. One end of piston rod 38 is threadably secured to piston 32 and slidably extends through bore 40 formed in body member 16. Body member 16 is provided with a pair of spaced apart O-rings 42 and 44 which sealably embrace piston rod 38. Body member 16 includes a threaded discharge port 46 which threadably receives a check valve assembly 48. Check valve assembly 48 is in communication with the water to be pumped and includes check valves 50 and 52 which permit the flow of water in the direction of the arrows in FIG. 5. Bore 54 extends inwardly from one side of the body member 16 to provide fluid communication between chamber 36 and discharge port 46.

Body member 16 also includes a threaded discharge port 56 which threadably receives member 58 which may be a pipe, hose, etc. Bore 60 extends inwardly from one side of the body member 16 to provide fluid communication between chamber 62 of cylinder 14. Body member 16 is also provided with weep hole or opening 64 which extends inwardly from one side thereof to extend around the piston rod 38 (FIG. 4).

Bore 66 extends into one end of the piston rod 38 to movably receive the nut assembly 68 mounted on rod 72 as shown in FIG. 4. The end of bore 66 is closed by a disc element 70 secured thereto which slidably receives the rod 72 extending therethrough.

Piston 74 is secured to piston rod 38 within cylinder 14 so as to define the chambers 62 and 76. A bore 78 extends through piston 74 and through the disc element 70 to provide fluid communication between chamber 76 and bore 66. A pilot valve 80 is secured to the other end of rod 72 for movement therewith. Pilot valve 80 is slidably mounted in pilot bore 82 formed in valve body 12 and extending between chamber 76 and the outer end of body 12. Pilot valve 80 is of the spool type comprising spaced apart spool valve elements 84, 86 and 88. For purposes of description, the annular lands on opposite sides of valve element 86 will be referred to by the reference numerals 90 and 92 respectively. Pilot valve adjustment bolt 94 is secured to and extends from the outer end of pilot valve 80 through plug 96 which is mounted in the outer end of cavity 98. Adjustment of the nut assembly 100 limits the inward travel of pilot valve 80 relative to plug 96 and valve body 12. Bore 102 is formed in valve body 12 and has the hose 58 threadably received in its outer end. Passageway 104 extends between bore 102 and cavity 98.

Figure 5:
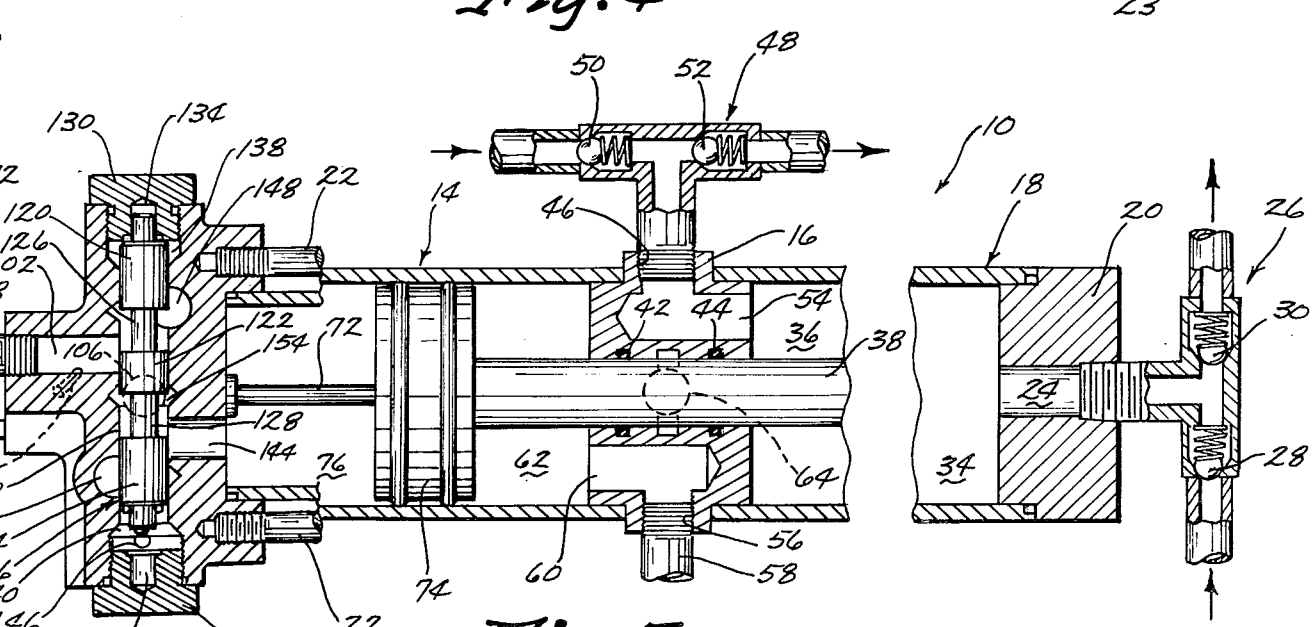
FIG. 5 is a sectional view seen on lines 5—5 of FIG. 4.

Valve body 12 is provided with a threaded port 106 having a hose or line 108 secured therein. Line 108 is in fluid communication with a hydraulic pump 110 which is fluidly connected to oil reservoir 112 by line 114. A main valve 116 is slidably mounted in main bore 118 formed in valve body 12 as illustrated in FIGS. 4 and 5. Main valve 116 is of the spool type comprising spaced apart spool valve elements 120, 122 and 124. For purposes of description, the annular lands on opposite sides of valve element 122 will be referred to by the reference numerals 126 and 128 respectively. As seen in FIG. 5, plugs 130 and 132 are mounted on valve body 12 to close the opposite outer ends of the main bore 118. Plugs 130 and 132 have bores 134 and 136 formed in the inner ends thereof respectively which are adapted to receive the ends of the main valve 116 as seen in the drawings. For purposes of description, the numerals 138 and 140 will be used to identify the outer portions of main bore 118 respectively.

Figure 6:
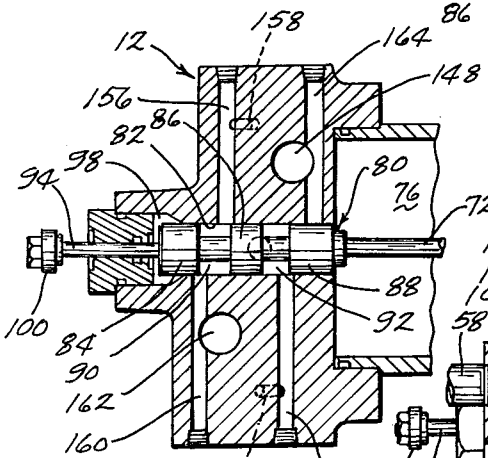
FIG. 6 is a sectional view seen on lines 6—6 of FIG. 4.

Bore 142 is formed in valve body 12 and extends between main bore 118 and pilot bore 82. A bore 143 extends into valve body 12 as seen in FIG. 6 with the outer end being closed by a cap screw or plug (not shown). Bore 143 communicates with pilot bore 82 as seen in FIG. 6. Bore 144 extends between main bore 118 and chamber 76 while bore 146 extends between bore 143 and outer portion 140 of main bore 118.

Figure 1:
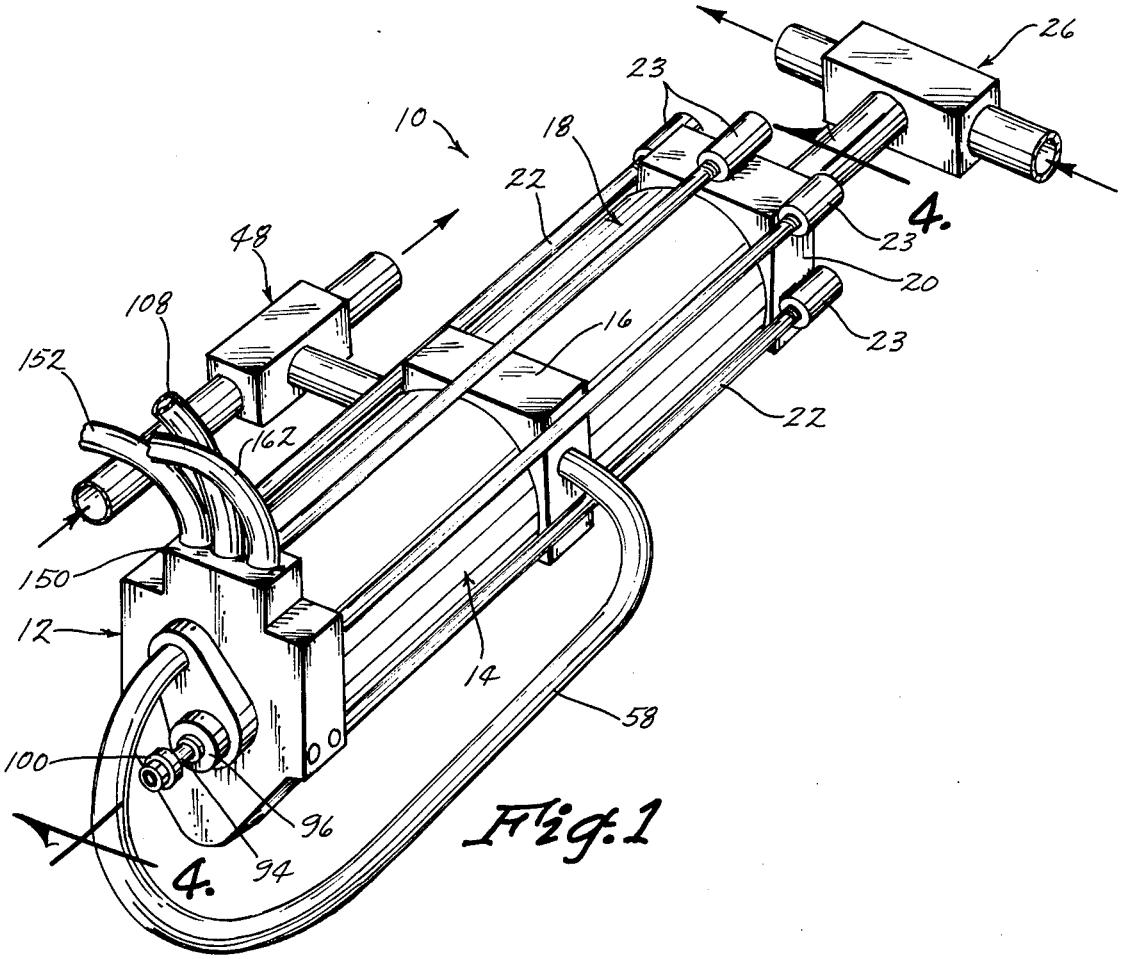
FIG. 1 is a perspective view of the pump of this invention.
Figure 2:
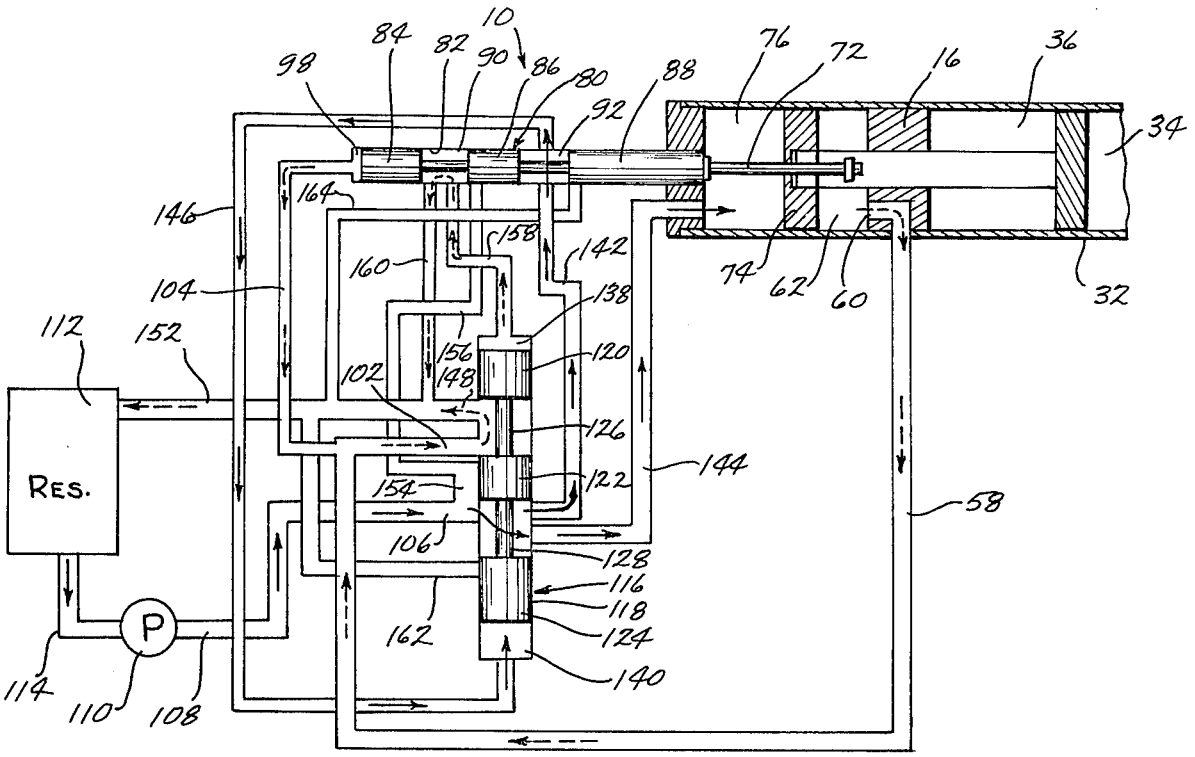
FIG. 2 is a schematic view of the circuitry of the invention.
Figure 3:
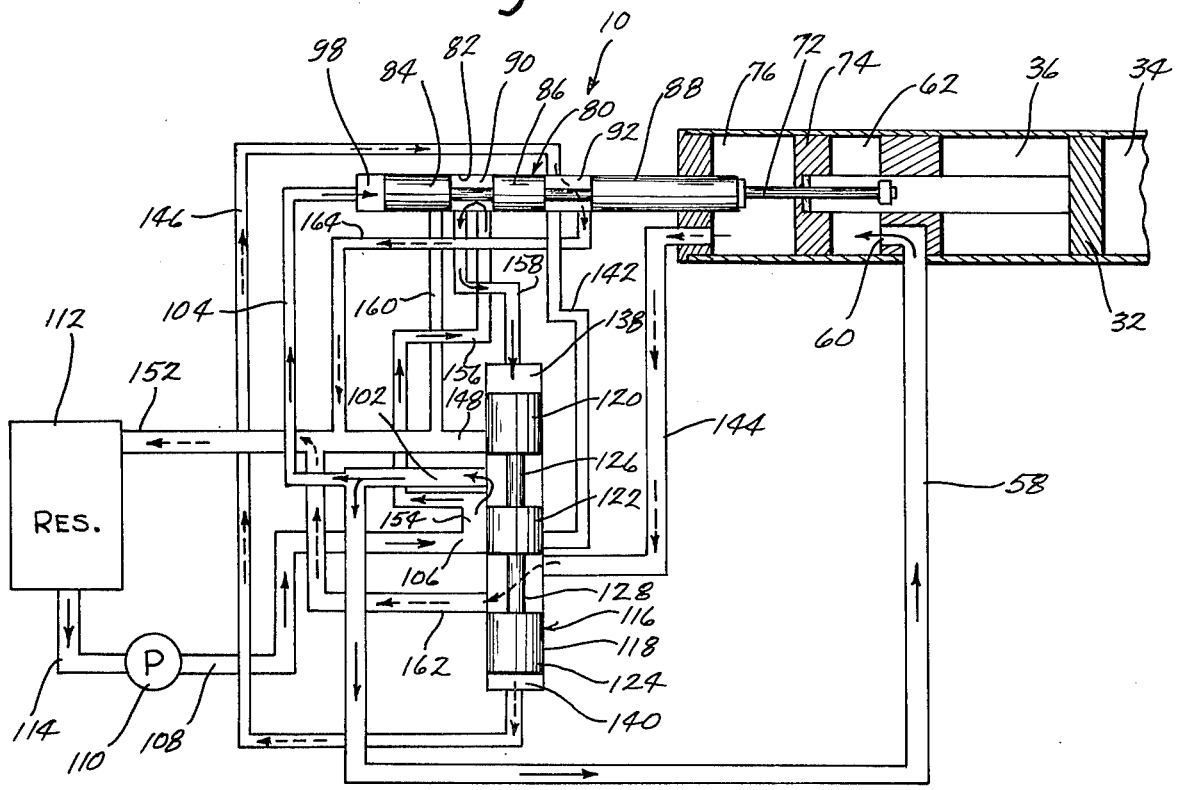
FIG. 3 is a schematic view of the circuitry illustrating the pilot valve and main valve in different positions from that seen in FIG. 2.

In the schematic of FIGS. 2 and 3, the numeral 146 will refer to both of the bores 143 and 146. Bore 148 in valve body 12 extends from main bore 118 to the threaded port 150 having hose or line 152 secured therein. Line 152 is connected to the hydraulic reservoir 112 in customary fashion. Bore 148 communicates with bore 102 when the main valve is in the position of FIGS. 2 and 5 but does not communicate with bore 102 when the main valve is in the position of FIG. 3. Main bore 118 is provided with a cut-away portion 154 which permits fluid communication between bore 106 and bore 102 when the main valve 116 is in the position of FIG. 3.

Bore 156 extends inwardly into valve body 12 (FIG. 6) to communicate with pilot bore 82 and has its outer end closed by a suitable threaded cap or plug (not shown). Passageway 158 extends between bore 156 and portion 138 of main bore 118. In the schematic of FIGS. 2 and 3, the numeral 158 will include both of the elements 156 and 158 for purposes of description. As seen in FIGS. 2 and 3, passageway 158 communicates with the annaular land 90.

Bore 160 extends into valve body 12 so that its inner end communicates with pilot bore 82. The outer end of bore 160 is closed with a conventional threaded cap or plug (not shown). Bore 162 extends between bore 160 and main bore 118.

Bore 164 extends into valve body 12 and has its outer end closed by a conventional cap or plug (not shown). The inner end of bore 164 communicates with pilot bore 82 as seen in FIG. 6. Bore 164 also communicates with bore 148 as seen in the drawings. Bore 152 provides communication between main bore 118 and bore 160. Bore 166 provides communication between pilot bore 82 and cut-away area 154.

In operation, chambers 76 and 62 are filled or are in communication with the hydraulic fluid while chambers 36 and 34 are in communication with the water or fluid to be pumped. Initially, the pilot valve 80 and the main valve 116 are in the position illustrated in FIG. 2. Upon actuation of the pump, hydraulic fluid is supplied from the pump 110 through the hose 108 to the port 106. The hydraulic fluid is supplied to the bore 144 through the annular land 128 so that the oil is pumped into the chamber 76. Oil is also supplied from the port 106 to the pilot valve by means of the passageway 142. Passageway 142 communicates with the annular land 92 so that the oil is supplied to the area 140 of main bore 118 by means of passageway or bore 146 so that the main valve 116 is urged upwardly as viewed in FIG. 2. The upward movement of the pilot valve 116 as viewed in FIG. 2 causes the oil in chamber 138 to be forced through the passageway 158 into the passageway 160 so that the oil is returned to the reservoir.

As the oil is supplied through the passageway 144 into chamber 76, the pressure therein builds up so that the piston 74 is moved to the right as viewed in FIG. 2 so that the oil in chamber 62 is compressed and forced outwardly through the port 60 and into the hose 58. The discharged oil passes through the hose 58 to the bore 102 which communicates with the annular land 126 so that the oil can by-pass the main valve and return to the reservoir by means of hose 152 as illustrated in FIG. 2. Movement of the piston 74 to the right as viewed in FIG. 2 and 4 causes the piston 32 to also move to the right which causes the water in chamber 34 to be forced outwardly through the check valve member 30 of check valve 26. The movement of the piston 32 to the right as viewed in FIG. 4 causes a negative pressure or suction to be created in chamber 36 so that water will be drawn thereinto through the valve member 50 of check valve 48.

The pistons 74 and 32 move to the right until the nut 68 is engaged by the disc 50 which causes the pilot valve to be moved to the right as viewed in FIGS. 2 and 4. FIG. 3 illustrates the pilot valve having been moved to the right from the position of FIG. 2. FIG. 3 also illustrates the piston 74 as having begun its return travel to the left. The movement of the pilot valve from the position of FIG. 2 to the position of FIG. 3 reverses the operation of the apparatus.

In FIG. 3, the hydraulic oil is pumped from the pump 110 through the hose 108 to the cut-away portion 154. Valve member 122 prevents the flow of oil into the passageway 142 and the passageway 144 as was possible when the pilot valve was in the position of FIG. 2. The oil is supplied from the bore 106 to the bore 166 as indicated by the arrows in FIG. 3. The oil in passageway 166 communicates with annular land 90 in pilot bore 82 so that the oil is supplied to passageway 158 which in turn supplied the oil to portion 138 of main bore 118 so that the main valve 116 is urged downwardly as viewed in FIG. 3. The oil being supplied to the bore 106 by-passes the main valve as indicated by the arrow in FIG. 3 by means of the annular land 126 so that oil is supplied to the bore 102 and the hose 58. Oil is pumped into the chamber 62 by means of the port 60 so that the piston 74 is moved to the left as illustrated in FIG. 3. Movement of the piston 74 to the left in FIG. 3 causes the oil in chamber 76 to be discharged therefrom through the passageway 144 and to the main bore 118. The oil being forced through passageway 144 by-passes the main valve by means of the annular land 128 and is supplied to the bore 162 which communicates with the hose 152 so that the oil is returned to the reservoir. Movement of the piston 74 to the left as viewed in FIG. 3 also causes the piston 32 to be moved to the left so that water in chamber 36 is forced outwardly through the port 54 into the check valve 48 and outwardly past the valve member 52. Movement of the piston 32 as viewed in FIGS. 3 and 4 causes water to be drawn into the chamber 34 by means of the check valve 28. Thus it can be seen that repeated strokes of the piston 32 cuases water to be pumped through both of the check valves 26 and 48 in alternate intermittent fashion.

The piston 74 continues its movement to the left as viewed in FIG. 3 until the pilot valve 80 returns to the position of FIG. 2. As seen in FIG. 3, oil is also pumped from the pump 110 to the passageway 156 which supplies oil to the portion 138 of main bore 118 by means of the passageway 158 to urge the main valve 116 downwardly as viewed in FIG. 3. The piston 74 moves to the left until it engages the end of the pilot vave 80 to move the pilot valve from the position of FIG. 3 to the position of FIG. 2 so that a new cycle is begun. When the piston 74 moves the pilot valve 80 from the position of FIG. 3 to the position of FIG. 2, valve member 86 closes passageway 166 so that pressure is removed from portion 138 of main bore 116. The hydraulic oil will be supplied from the pump 110 to chamber 62 and to the main bore 118 via land 126 until the pressure in chamber 62 reaches a sufficient level so that the pressure will build up within main bore 118 at an annular land 126 to cause the main valve 116 to move upwardly from the position of FIG. 3 to the position of FIG. 2. With the main valve 116 having been moved to the position of FIG. 2, the hydraulic oil from pump 110 is again supplied to the passageway 144 so that the oil will enter the chamber 76 to repeat the cycle just described.

Thus it can be seen that an improved hydraulic pump has been provided which permits the pumping of fluid from at least two sources. The movement of the piston 34 causes the pilot valve and main valve to move between the positions of FIGS. 2 and 3 so that water is alternately pumped from the chambers 36 and 34 as described. Thus it can be seen that an improved hydraulic pump has been provided which has a minimum number of moving parts to reduce the maintenance thereof. Thus it can be seen that the pump of this invention accomplishes at least all of its state objectives.

I claim:

1. A fluid motor-driven pump comprising, a pump work piston operating within a pump work chamber provided with inlet and outlet means, said pump work piston drivingly connected to a fluid motor, said fluid motor comprising a motor piston fluidly movable in a cylinder alternately in opposite directions between first and second positions and having chambers on opposite sides thereof, a pilot valve connected to said motor piston by a lost motion means and adapted to be physically moved alternately in opposite directions by said motor piston towards first and second positions, a main valve adapted to be fluidly moved alternately in opposite directions between first and second positions, a motor pump in fluid communication with said chambers through said main valve to move said motor piston between said first and second positions, and said main valve through said pilot valve to move said main vlave between said first and second positions, and said pilot valve through said main valve to move said pilot valve towards said first and second positions, said piston being movable in one direction towards said first position by said motor pump fluid being in communication with one of said chambers, through said main valve when in said one position, to engagement with said pilot valve to move said pilot valve in said one direction and thereby place said motor pump in fluid communication through said pilot valve with said main valve to move said main valve to said second position whereupon said motor pump is placed in fluid communication through said main valve with the other chamber and said pilot valve to thereby fluidly move said pilot valve further in said one direction to said one position while moving said piston in the opposite direction relative to said pilot valve towards said second position for said motor piston whereupon said motor piston engages said pilot valve to move said pilot valve in the other direction and thereby place said motor pump in fluid communication through said pilot valve with said main valve to move said main valve to said one position whereupon said motor pump is placed in fluid communication through said main valve with said one chamber and said pilot valve to thereby fluidly move said pilot valve further in said other direction to said second position while moving said motor piston in said one direction towards said first position which is opposite the direction said pilot valve is moving.

2. The structure of claim 1 wherein said pilot valve and motor piston are axially aligned with opposing end faces in said other chamber.

3. The structure of claim 1 wherein said pilot valve is slidably movable in a bore and includes a spool element with annular lands on opposite sides thereof and a first passageway extends from said one land to one end of said main valve and a second passageway extends from the other land to the other end of said main valve with a third passageway connected to said motor pump and is connected to said bore between said first and second passageways.

4. The structure of claim 3 wherein said main valve is slidable in a bore and includes a trio of spool elements with annular lands therebetween, a fourth passageway extends from said motor pump to said main valve bore for alternate communication with said main valve annular lands, and a fifth passageway extends from one of said main valve lands to the other end of said pilot valve and to said one chamber, and a sixth passageway extends from the other main valve land to said other chamber.

* * * * *